US011718460B2

(12) United States Patent
Huffer et al.

(10) Patent No.: US 11,718,460 B2
(45) Date of Patent: Aug. 8, 2023

(54) EASY-OPEN MEDIA WRAPPER

(71) Applicant: SONOCO DEVELOPMENT, INC., Hartsville, SC (US)

(72) Inventors: Scott William Huffer, Hartsville, SC (US); Brent Bosman, Florence, SC (US)

(73) Assignee: SONOCO DEVELOPMENT, INC., Hartsville, SC (US)

( * ) Notice: Subject to any disclaimer, the term of this patent is extended or adjusted under 35 U.S.C. 154(b) by 126 days.

(21) Appl. No.: 17/145,913

(22) Filed: Jan. 11, 2021

(65) Prior Publication Data

US 2021/0130065 A1 May 6, 2021

Related U.S. Application Data

(60) Continuation of application No. 16/268,931, filed on Feb. 6, 2019, now Pat. No. 10,919,678, which is a (Continued)

(51) Int. Cl.
*B65D 75/58* (2006.01)
*B65D 65/10* (2006.01)

(Continued)

(52) U.S. Cl.
CPC ..... *B65D 75/5827* (2013.01); *B65D 65/10* (2013.01); *B65D 75/08* (2013.01); *B65D 85/62* (2013.01)

(58) Field of Classification Search
CPC .... B65D 17/40; B65D 17/401; B65D 17/402; B65D 75/5827; B65D 75/08; B65D 75/5805
See application file for complete search history.

(56) References Cited

U.S. PATENT DOCUMENTS 2,344,559 A * 3/1944 Newman ..... B65D 75/68 229/203
2,596,620 A 5/1952 Townsend (Continued)

OTHER PUBLICATIONS

Non-Final Office Action from U.S. Appl. No. 14/812,448 dated Jan. 5, 2018.

(Continued)

*Primary Examiner* — Derek J Battisti
(74) *Attorney, Agent, or Firm* — Nelson Mullins Riley & Scarborough LLP

(57) ABSTRACT

A structure is described for forming a wrapper, e.g., for print media, where the structure includes lines of weakness for facilitating a user's tearing of the wrapper to access the contents. The lines of weakness may include a first line of weakness that extends along a fold line of an envelope fold forming one of the front or rear or right sides of the wrapped package, as well as a second line of weakness that extends substantially perpendicularly to the respective longitudinal fold lines and a third line of weakness that extends between the first line of weakness and the second line of weakness and is disposed at a non-zero angle with respect to each. In this way, a tear initiated near the first line of weakness and may be propagated along the other lines of weakness to create an opening for accessing the product.

15 Claims, 8 Drawing Sheets

Related U.S. Application Data division of application No. 14/812,448, filed on Jul. 29, 2015, now Pat. No. 10,239,677.

(51) Int. Cl.
*B65D 75/08* (2006.01)
*B65D 85/62* (2006.01)

(56) References Cited

U.S. PATENT DOCUMENTS

| | | | | |
|---|---|---|---|---|
| 3,684,086 | A | 8/1972 | Harrison | |
| 3,790,744 | A | 2/1974 | Bowen | |
| 5,011,014 | A | 4/1991 | Bork | |
| 5,158,499 | A * | 10/1992 | Guckenberger | B32B 27/08 383/207 |
| 5,487,503 | A | 1/1996 | Sato | |
| 5,630,308 | A | 5/1997 | Guckenberger | |
| 6,427,840 | B1 | 8/2002 | Flacker | |
| 7,118,792 | B2 | 10/2006 | Hewitt et al. | |
| 7,165,675 | B2 | 1/2007 | Anderson et al. | |
| 7,588,143 | B2 | 9/2009 | Focke | |
| 8,156,715 | B2 | 4/2012 | Nowak et al. | |
| 8,342,389 | B2 | 1/2013 | Mills et al. | |
| 9,302,836 | B2 | 4/2016 | Cowan et al. | |
| 2005/0006265 | A1 * | 1/2005 | Anderson | B41J 13/0081 206/449 |
| 2006/0027637 | A1 * | 2/2006 | Conrad | B65D 75/5844 229/87.05 |
| 2012/0024939 | A1 | 2/2012 | Cowan et al. | |

OTHER PUBLICATIONS

Non-Final Office Action from U.S. Appl. No. 14/812,448 dated May 7, 2018.

Non-Final Office Action from U.S. Appl. No. 14/812,448 dated Jul. 26, 2018.

* cited by examiner

EASY-OPEN MEDIA WRAPPER

CROSS-REFERENCE TO RELATED APPLICATIONS

This application is a continuation of U.S. patent application Ser. No. 16/268,931, filed Feb. 6, 2019, which is a divisional of U.S. patent application Ser. No. 14/812,448, filed Jul. 29, 2015, now issued as U.S. Pat. No. 10,239,677, each of which are incorporated by reference herein in their entireties.

BACKGROUND

The present disclosure relates in general to packaging for products, and more particularly to structures for packaging, such as wrappers for stackable media (e.g., reams of paper). The disclosure is especially concerned with structures for wrapping packages that include a line of weakness configured to facilitate opening of the package without necessitating the user of a tear strip or pull tab to initiate tearing of the wrapper.

Stackable media, such as reams of paper, are often packaged in discrete bundles using a wrapper, such as a laminate sheet that is sealed to create the package. The arrangement of the package contents in such cases is often important for facilitating a consumer's use of the contents. In the case of a ream of paper, for example, maintaining the paper in a stacked orientation is important for allowing the user to feed the paper into a machine for end use, such as into a copier or printer.

At the same time, OEMs, converters, and manufacturers aim to produce products in a simple, cost-efficient way while meeting consumer needs.

BRIEF SUMMARY

Embodiments of the invention described herein therefore provide improved structures for creating packages, such as wrappers for packaging reams of paper, that include a line of weakness that is configured to facilitate the initiation and controlled propagation of a tear in the wrapper to allow the package to be opened without the use of a separate opening feature or mechanism, such as a tear strip or pull tab. Because the line of weakness is built-into the structures (e.g., not an add-on feature), the structures can be produced and used for packaging in a more simple and cost effective manner. At the same time, the configuration of the line of weakness allows the package to be opened while substantially preserving the arrangement and orientation of the package contents, such that the contents can be more easily accessed and used.

Accordingly, in some embodiments, a media wrapper for wrapping a stack of print media is provided. The media wrapper comprises a structure configured to be wrapped and sealed around a stack of print media to form a wrapped package. The structure has a front edge, a rear edge, a left edge, and a right edge. Upon wrapping the structure around the stack of print media, the structure is configured to form two pairs of longitudinal fold lines, two pairs of transverse fold lines, and two pairs of lateral fold lines defining a left side, a right side, a front side, a rear side, a top side, and a bottom side of the wrapped package. Moreover, one of the left or right edges of the structure is configured to overlap the other to form a girth seal on the bottom side of the wrapped package.

The front and rear edges of the structure are each configured to be folded into an envelope fold so as to form the front and rear sides of the wrapped package, each envelope fold being defined by fold lines arranged to form a pair of side flaps, a bottom flap overlapping the side flaps, and a top flap overlapping and sealed to the bottom flap. In addition, the structure includes a line of weakness configured to facilitate opening of the media wrapper. The line of weakness comprises a first line of weakness portion that extends along a fold line of the envelope fold forming a respective one of the front or rear sides of the wrapped package, a second line of weakness portion that extends substantially perpendicularly to the respective longitudinal fold lines, and a connecting line of weakness portion that extends between the first line of weakness portion and the second line of weakness portion and is disposed at a non-zero angle with respect to each.

In some embodiments, the non-zero angle of the connecting line of weakness portion may be selected such that a tear initiated along the first line of weakness portion is directed towards the second line of weakness portion and propagates along substantially an entire length of the second line of weakness portion. Additionally or alternatively, the second line of weakness portion may circumscribe the wrapped package. A distance between a proximal end of the first line of weakness portion and the second line of weakness portion may be greater than a distance between the proximal end of the first line of weakness portion and the front edge of the structure. In some cases, a depth of the line of weakness is greater along at least part of the first line of weakness portion or the connecting line of weakness portion as compared to the second line of weakness portion.

The structure may be a laminate structure and may comprise two layers of material. A first layer of the two layers may comprise oriented polypropylene (OPP) and a second layer of the two layers may comprise polyethylene terephthalate (PET).

In some cases, the first line of weakness portion may at least partially define one of the side flaps of the wrapped package. Moreover, the line of weakness may be laser scored. The structure may further include a printed indicia proximate the first line of weakness portion indicating a location for a user to initiate a tear to open the media wrapper.

In other embodiments, a media wrapper for wrapping a stack of print media is provided, the media wrapper comprising a structure configured to be wrapped and sealed around a stack of print media. In an unwrapped configuration, the structure has a front edge, a rear edge, a left edge, and a right edge. The structure includes a line of weakness configured to facilitate opening of the media wrapper. In the unwrapped configuration the line of weakness comprises a first line of weakness portion that extends away from the front edge of the structure to a point disposed from the front edge of the structure, a second line of weakness portion that extends substantially parallel to the front edge of the structure and is spaced from the first line of weakness portion, and a connecting line of weakness portion extending between the first line of weakness portion and the second line of weakness portion at an a non-zero angle with respect to each of the first and second line of weakness portions. The line of weakness is configured such that, in the wrapped configuration, a tear initiated along the first line of weakness portion is directed towards the second line of weakness portion via the connecting line of weakness portion and propagates substantially an entire length of the second line of weakness portion to open a wrapped stack of print media.

In some cases, a depth of the line of weakness may be greater along at least part of the first line of weakness portion or the connecting line of weakness portion as compared to the second line of weakness portion. The second line of weakness portion may circumscribe the wrapped package. Additionally or alternatively, the structure may be a laminate structure and may comprise two layers of material.

In still other embodiments, a method of forming a media wrapper for wrapping a stack of print media is provided. The method comprises providing a structure having a front edge, a rear edge, a left edge, and a right edge; wrapping the structure around a stack of print media so as to define a left side, a right side, a front side, a rear side, a top side, and a bottom side of a wrapped package formed by two pairs of longitudinal fold lines, two pairs of transverse fold lines, and two pairs of lateral fold lines; and sealing one of the left or right edges of the structure in an overlapping configuration with respect to the other of the left or right edges of the structure to form a girth seal on the bottom side of the wrapped package. The method further comprises folding each of the front and rear edges of the structure into a respective envelope fold so as to form the front and rear sides of the wrapped package by creating fold lines arranged to form a pair of side flaps, a bottom flap overlapping the side flaps, and a top flap overlapping the bottom flap for each of the front and rear sides; sealing each top flap to the corresponding bottom flap; and creating a line of weakness in the structure.

The line of weakness comprises a first line of weakness portion that extends along a fold line of the envelope fold forming a respective one of the front or rear sides of the wrapped package, a second line of weakness portion that extends substantially perpendicularly to the respective longitudinal fold lines, and a connecting line of weakness portion that extends between the first line of weakness portion and the second line of weakness portion and is disposed at a non-zero angle with respect to each.

Providing the structure may comprise laminating a first layer of material to a second layer of material. Creating the line of weakness may comprise varying a depth of the line of weakness such that the depth is greater along at least part of the first line of weakness portion or the connecting line of weakness portion as compared to the second line of weakness portion. The first line of weakness portion may at least partially define one of the side flaps of the wrapped package. Creating the line of weakness may comprise laser scoring the line of weakness. Moreover, the method may comprise providing a printed indicia proximate the first line of weakness portion indicating a location for a user to initiate a tear to open the media wrapper.

BRIEF DESCRIPTION OF THE SEVERAL VIEWS OF THE DRAWING(S)

Having thus described the disclosure in general terms, reference will now be made to the accompanying drawings, which are not necessarily drawn to scale, and wherein:

DETAILED DESCRIPTION OF THE DRAWINGS

Figure 1A:
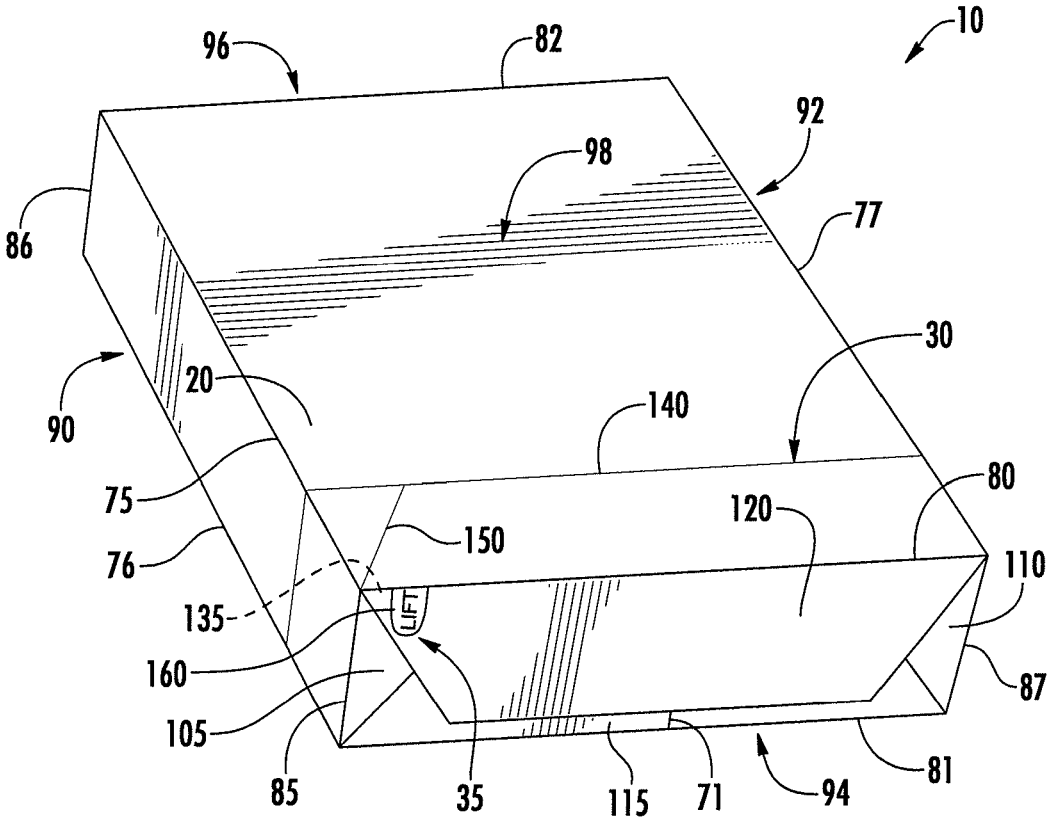
FIG. 1A is a perspective view of a top side of a package having a wrapper formed of a structure in a wrapped configuration according to an example embodiment.

The present invention now will be described more fully hereinafter with reference to the accompanying drawings in which some but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

As noted above, stackable products, such as sheets of paper or other print media, for example, are typically packaged for distribution and sale in discrete quantities in a stacked arrangement. In the case of paper, for example, a quantity of paper (e.g., 500 sheets) may be packaged together by applying a wrapper to produce a wrapped ream of paper. The wrapper may be a sheet of material, such as a larger sheet of paper or a laminate structure formed of multiple plies of material, such as a polymer film laminate. The sheet forming the wrapper may be applied to the stacked products (e.g., the stacked quantity of paper) and sealed so as to enclose the products within the wrapper. As a result, a user of such conventionally wrapped products generally must manually break the seal (e.g., by tearing apart folded edges) or otherwise cut through the wrapper (e.g., such as by using a sharp edge or scissors) to gain access to the products contained therein. In the process of such labor intensive efforts to access the products, the arrangement of the products contained therein may be disturbed, such that the once generally vertical stack (of paper, for example) may, upon removal of the conventional wrapper, no longer be in a vertical orientation, but rather may be in a slanted or otherwise disheveled pile. In addition, if a sharp object is used to cut through the wrapper there is a risk of damaging the products held therein, such as by inadvertently cutting through one or more of the sheets of paper directly adjacent to the wrapper that is being cut, or (worse yet) causing bodily injury to the user due to mishandling of the sharp object used to cut through the wrapper.

In some cases, conventional wrappers may be modified in an effort to facilitate the opening of the packaged product, such as by providing tear strips or pull tabs to allow the wrapper to be removed more easily. In the case of a conventional tear strip, the tear strip, which may be a strip of material embedded or otherwise applied to the wrapper that, upon separation of the tear strip from the wrapper, results in a portion of the wrapper being removed or becoming separable from the remainder of the wrapper, thereby providing access to the contents therein. In the case of a conventional pull tab, which is applied and secured to the wrapper, a portion of the wrapper secured to the pull tab may be configured to be moved with the pull tab, such that separation of the pull tab by the user initiates a tearing of the wrapper as the attached portion of the wrapper is displaced with the pull tab. In each of these conventional cases, however, the incorporation of the tear strip or the pull tab to the wrapper is an additional step in the manufacturing process that must be undertaken by the converter or OEM, which adds cost to the process and often slows down the process of packaging and distributing the product.

Through applied ingenuity and hard work, the inventors have discovered that a media wrapper may be formed for wrapping a stack of products, such as print media, where the wrapper is made of a structure that includes a line of weakness configured (e.g., having a length, depth, shape, position, etc.) to allow a user to more easily initiate a tear in the wrapper, without the need for a separate feature such as a pull tab or tear strip. The line of weakness described herein are and further configured to propagate the tear in a controlled manner to create an opening in the wrapper, thereby allowing the user to access and withdraw the products held therein in a more reliable and efficient manner.

Figure 1B:
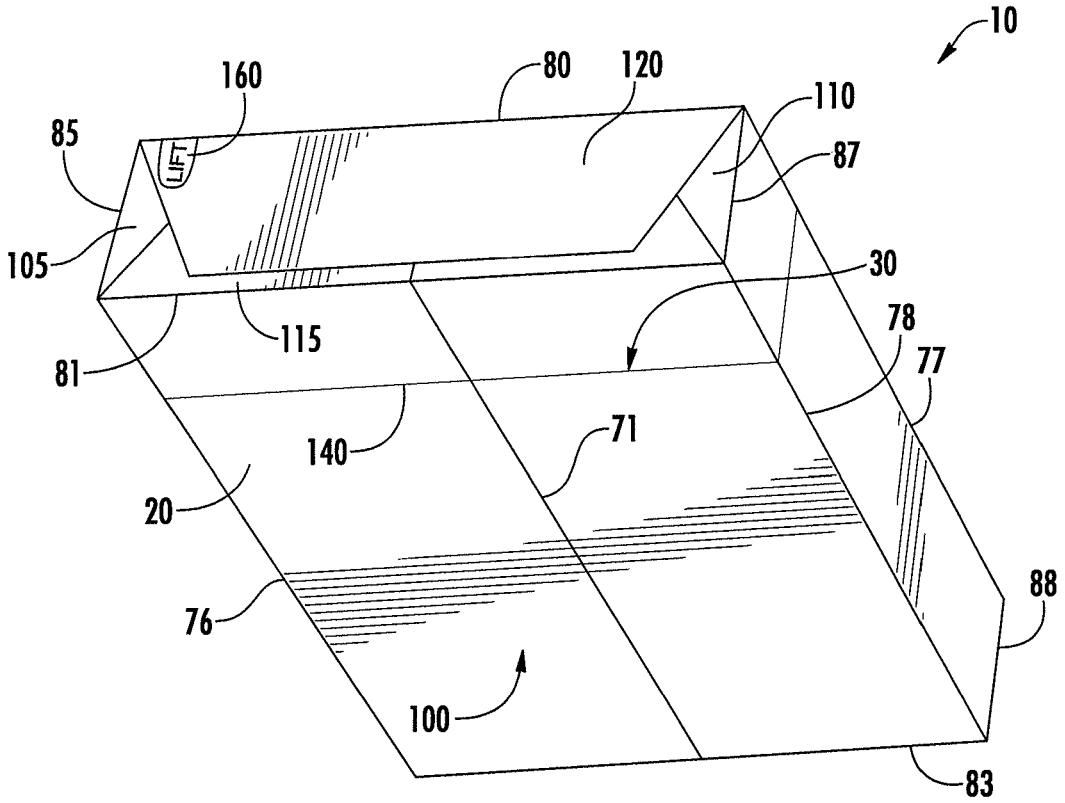
FIG. 1B is a perspective view of a bottom side of the package of FIG. 1A according to an example embodiment.

Turning to FIGS. 1A and 1B, for example, a wrapped package 10 is shown where the package may be (as an example) a stack of print media such as paper. It is noted that although the example of a stack of print media, such as paper, is used herein for the purpose of explanation, embodiments of the present invention may be applied to wrappers formed of laminated structures that are used to package various other products, including cans, toys, pencils, clothes, and so on.

Figure 2:
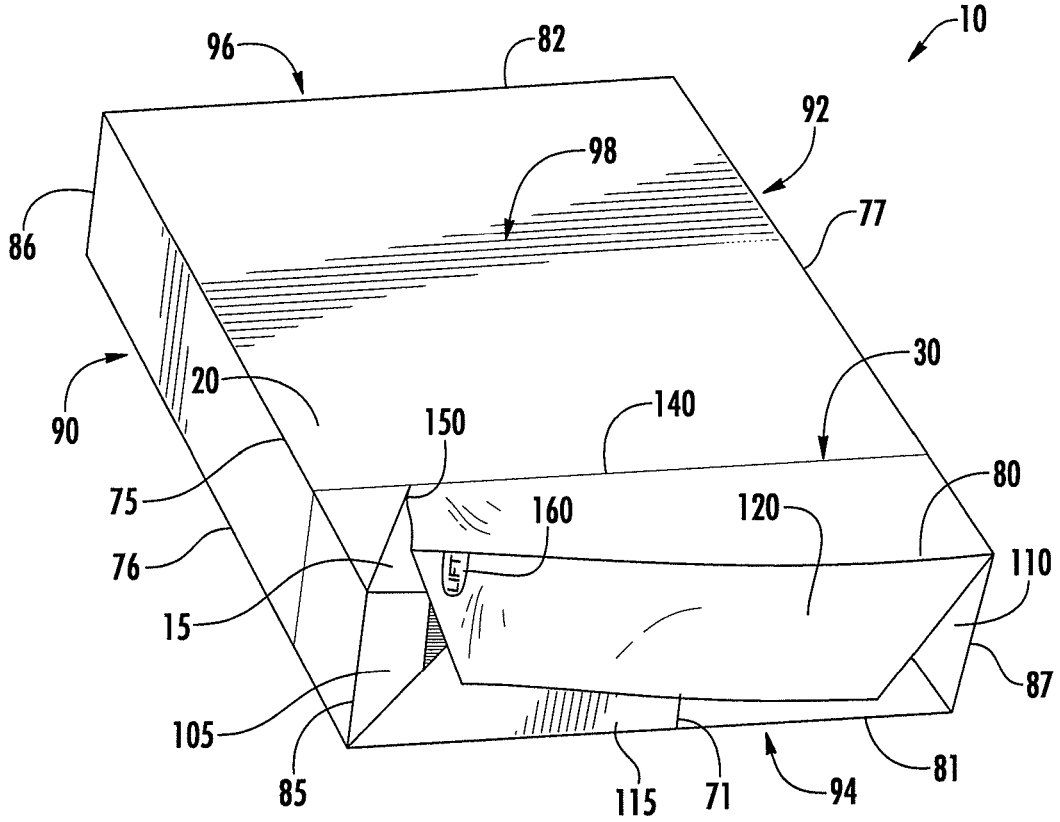
FIG. 2 is a perspective view of the package of FIG. 1A, where a tear is initiated in the wrapper by a user according to an example embodiment.
Figure 3:
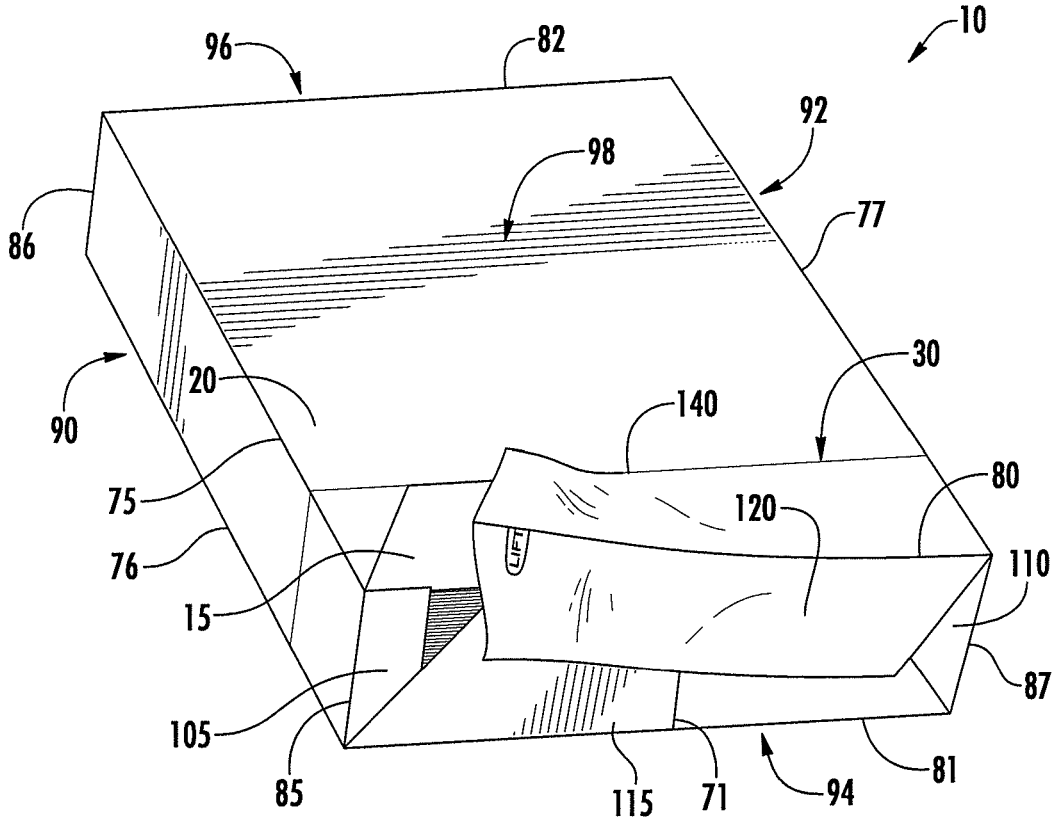
FIG. 3 is a perspective view of the package of FIG. 1A, where the tear is propagating to open the package according to an example embodiment.
Figure 4:
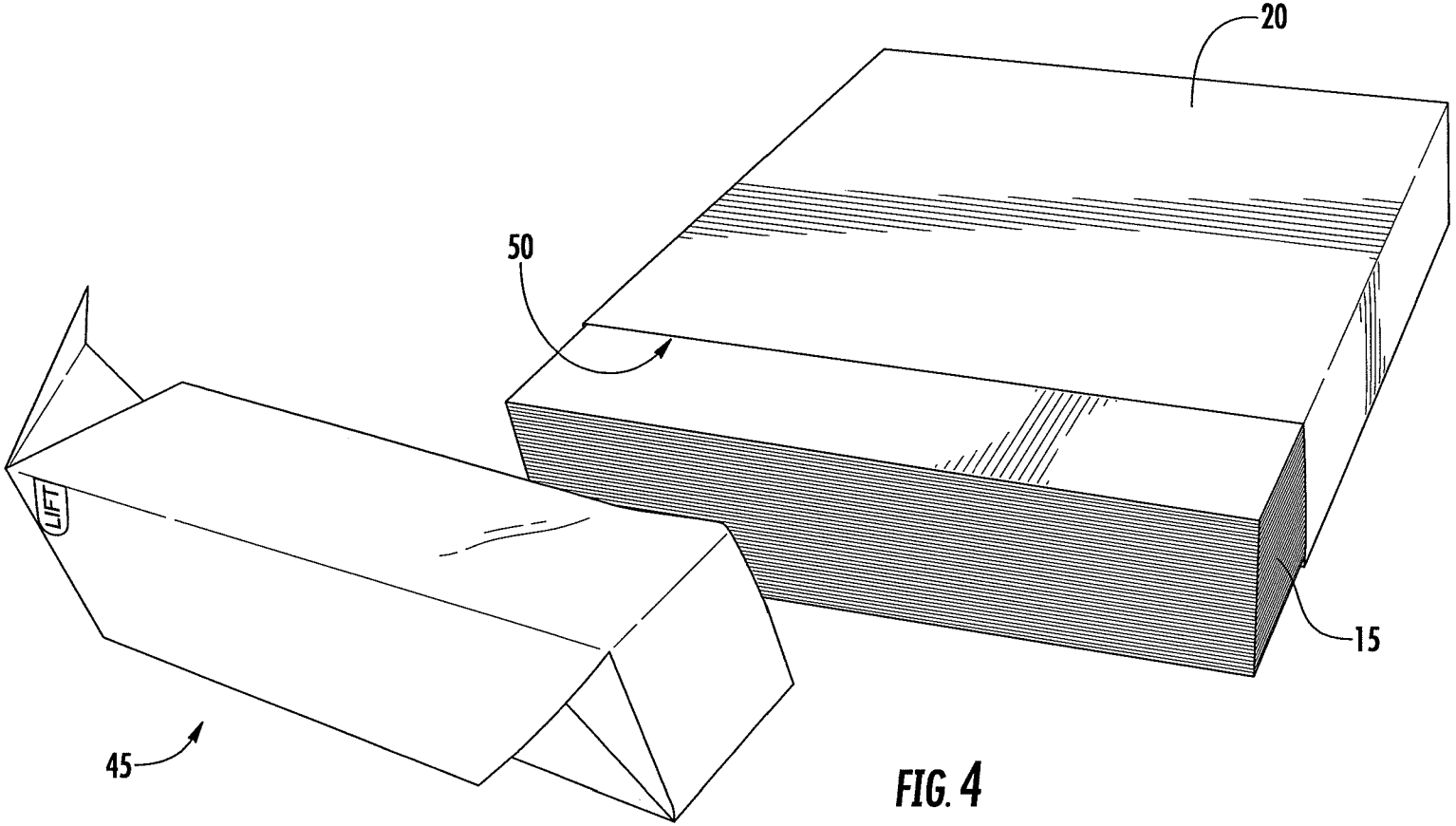
FIG. 4 is a perspective view of the package of FIG. 1A in an unwrapped configuration according to an example embodiment.

With continued reference to the example depicted in FIGS. 1A and 1B, the wrapped package 10 may thus comprise a product 15, such as paper (shown in FIG. 4), that is initially enclosed and/or contained within a sealed wrapper 20 in the wrapped configuration of FIGS. 1A and 1B. The wrapper 20 may comprise a structure 25 (shown in FIGS. 5 and 6), and the structure may include a line of weakness 30 that is configured to facilitate opening of the media wrapper 20. The line of weakness 30 may be defined using precision die cutting or by laser scoring. In either case, the line of weakness 30 may be cut or scored at least partially into the structure 25. Once the wrapper 20 has been applied to the product, the wrapped package 10 may be configured such that a user may grip the edge 35 of an envelope fold on an end of the wrapped package 10. By pulling on the wrapper 20 at that location, the user may create a tear 40 as shown in FIGS. 2-3 that, upon continued application of force by the user, may be propagated along the line of weakness (FIGS. 2-3) until an end portion 45 of the wrapper 20 is removed from the package 10 to create an access opening 50 for withdrawing the product, as shown in FIG. 4.

Figure 5:
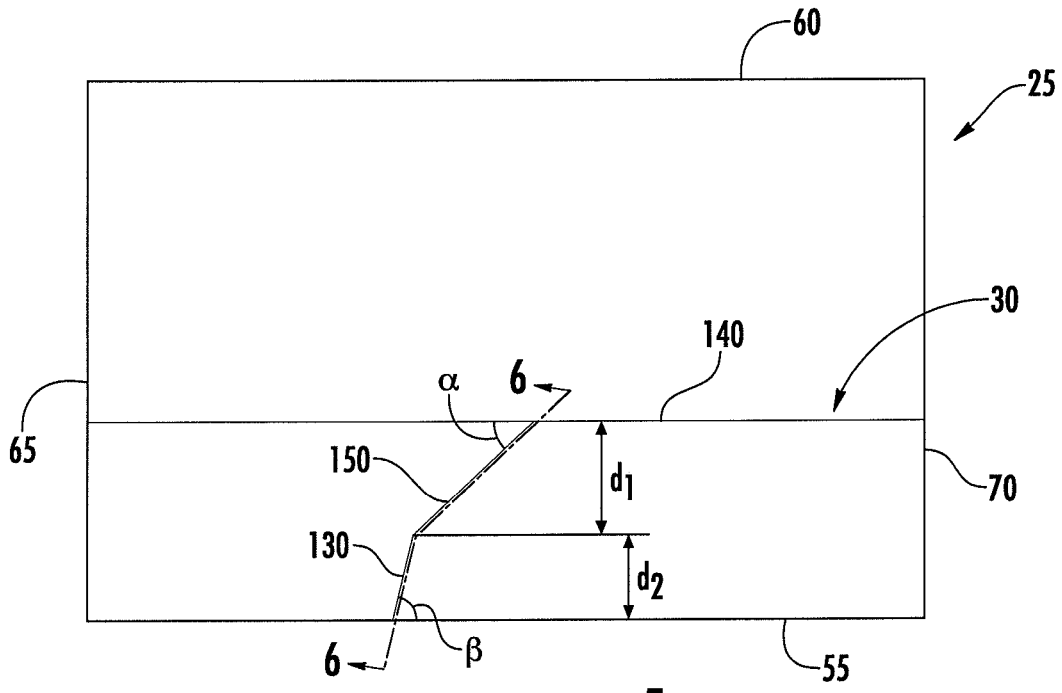
FIG. 5 is a plan view of a sheet for creating the wrapper according to another example embodiment.

A structure 25 used to form the media wrapper 20 is shown in an unwrapped configuration (e.g., as a flat sheet) in FIG. 5. In this regard, the structure 25, which may be configured to be wrapped and sealed around a stack of print media to form the wrapped package 10, may have a front edge 55, a rear edge 60, a left edge 65, and a right edge 70. When the structure 25 is wrapped around the stack of print media, as shown in FIGS. 1A and 1B, the structure is thus configured to form two pairs of longitudinal fold lines 75, 76, 77, 78, two pairs of transverse fold lines 80, 81, 82, 83, and two pairs of lateral fold lines 85, 86, 87, 88. The longitudinal fold lines 75, 76, 77, 78, the transverse fold lines 80, 81, 82, 83, and the lateral fold lines 85, 86, 87, 88 may thus define a left side 90, a right side 92, a front side 94, a rear side 96, a top side 98, and a bottom side 100 of the wrapped package. It is noted that although the terms "left," "right," "front," "rear," "top," and "bottom" are used in the description herein to refer to certain parts of the depicted package, such terms are used for ease of explanation only. Thus, it is recognized that the package 10 shown in FIG. 1A, for example, may be flipped over, turned around, etc., and as a result the "bottom side" may be at the top of the package and the "top side" may be at the bottom of the package, etc.

With continued reference to FIGS. 1A, 1B, and 5, one of the left or right edges 65, 70 of the structure 25 may be configured to overlap the other edge 65, 70 to form a girth seal 71 on the bottom side 100 of the wrapped package 10. Moreover, the front and rear edges 55, 60 of the structure 25 may each be configured to be folded into an envelope fold so as to form the front and rear sides 94, 96 of the wrapped package 10 as shown. Thus, each envelope fold may be defined by fold lines that are arranged to form a pair of side flaps 105, 110, a bottom flap 115 overlapping the side flaps, and a top flap 120 overlapping and sealed to the bottom flap.

Referring to FIGS. 1A, 1B, and 5, the line of weakness 30 provided in the structure 25 to facilitate opening of the media wrapper may comprise a first line of weakness portion 130 that extends along a fold line 135 of the envelope fold forming a respective one of the front or rear sides 94, 96 of the wrapped package 10. In particular, the first line of weakness portion 130 may extend away from the front edge 55 of the structure 25 to a point disposed from the first edge of the structure, as shown in FIG. 5. Accordingly, in FIGS. 1A and 1B, the first line of weakness portion 130 is disposed underneath and is hidden by the top flap 120 of the respective envelope fold.

The line of weakness 30 may further comprise a second line of weakness portion 140 that extends substantially perpendicularly to the respective longitudinal fold lines 75, 76, 77, 78, shown in FIGS. 1A and 1B, or substantially parallel to the front edge 55 of the structure 25, shown in FIG. 5, and may be spaced from the first line of weakness portion 130, as shown. As a result, a connecting line of weakness portion 150 that extends between and connects the first line of weakness portion 130 and the second line of weakness portion 140 may be provided, and the connecting line of weakness portion 150 may be disposed at a non-zero angle with respect to each. The non-zero angle of the connecting line of weakness portion 150 may, for example, be selected such that a tear initiated along the first line of weakness portion 130 is directed towards the second line of weakness portion 140 (e.g., via the connecting line of weakness portion 150) and propagates along substantially an entire length of the second line of weakness portion, as illustrated in the progression of the tear 40 depicted in FIGS. 1A-4.

The second line of weakness portion 140 may, in some cases, circumscribe the wrapped package 10, e.g., forming a continuous loop around the wrapped package, such that a tear propagated along the entire length of the second line of weakness portion 140 serves to separate the end portion 45 of the wrapper 20 from the remainder of the wrapper, creating an access opening 50 as shown in FIG. 4. In other cases, however, a gap may be provided between an end of the second line of weakness portion 140 that is connected to the connecting line of weakness portion 150 and a free end of the second line of weakness portion. In such cases, a user's application of force to initiate and propagate the tear to open the package may cause the tear to extend between the free end of the second line of weakness portion 140 to the point between the connecting line of weakness portion 150 and the second line of weakness portion 140, such that the tear propagates regardless of the presence of a preformed line of weakness and bridges the gap to cause the end portion 45 of the wrapper 20 to be severed from the remainder of the wrapper (resulting in the open configuration in FIG. 4).

With reference again to FIG. 5, the line of weakness 30 may be configured such that a distance $d_1$ between a proximal end of the first line of weakness portion 130 and the second line of weakness portion 140 is greater than a distance $d_2$ between the proximal end of the first line of weakness portion 130 and the front edge 55 of the structure 25. In some embodiments, an angle $\alpha$ formed between the connecting line of weakness portion 150 and the second line of weakness portion 140 may be between approximately 35° and 55°. Additionally or alternatively, the first line of weakness portion 130 may extend away from the front edge 55 of the structure 25 at an angle $\beta$ of approximately 70° to 90°. In this way, when the structure 25 shown in FIG. 5 is wrapped around and sealed to itself to form the media wrapper 20 for the wrapped package 10 shown in FIG. 1A, for example, the first line of weakness portion 130 may be substantially aligned with a fold line 135 forming one of the side flaps 105, 110, and a user may be able to more easily initiate a tear in the first line of weakness portion 130 by gripping a corresponding portion of the top flap 120 proximate the first line of weakness portion 130 (e.g., at the edge 35). Thus, in some embodiments, the first line of weakness portion 130 may at least partially define one of the side flaps 105, 110 of the wrapped package 20, as shown in FIGS. 1A-4, and the angle $\beta$ may be selected to accommodate the particular envelope fold being formed so as to facilitate such alignment.

The line of weakness 30 may have various configurations, and the first line of weakness portion 130, the second line of weakness portion 140, and the connecting line of weakness portion 150 may have different lengths, depths, orientations, and so on, with respect to each other and the structure 25. Referring to FIG. 5, in one embodiment, for example, the first line of weakness portion 130 may be defined starting at the front edge 55 of the structure 25 at a point that is approximately 6.625 inches from the left edge 65 of the structure. The first line of weakness portion 130 may extend to a point approximately 1.75 inches from the front edge 55 of the structure and approximately 7 inches from the left edge 65 of the structure, such that the angle $\beta$ is approximately 75°-80°. The second line of weakness portion 140 may be disposed approximately 4.125 inches from the front edge 55 of the structure 25 and may extend substantially parallel to the front edge from the left edge 65 to the right edge 70 of the structure. The connecting line of weakness portion 150 may extend from the end of the first line of weakness portion 130 to a point along the second line of weakness portion 140 that is disposed 9.5 inches from the left edge 65 of the structure 25, such that the angle $\alpha$ is approximately 40°-45°.

In some embodiments, a user may be guided as to the appropriate location to grip the media wrapper 20 for most efficiently initiating the tear through the use of a printed indicia 160 included on the structure 25 proximate the first line of weakness portion 130 (shown in FIGS. 1A-4). The printed indicia 160 may indicate (e.g., through text or pictures) the location for a user to initiate a tear 40 to open the media wrapper 20. For example, the printed indicia 160 may include the words "Tear Here," or "Open Here," or similarly may include an arrow or other marking to symbolize that a user may open the package at the marked location. At the same time, however, according to embodiments of the invention, no separate opening features, such as pull tabs or pull strips, are necessary, and the printed indicia 160 may be printed directly onto the outer surface of the structure 25 at a location that will eventually align with the location of the first line of weakness portion 130 once the structure has been folded about the printed media and will be visible to the user.

Figure 6:
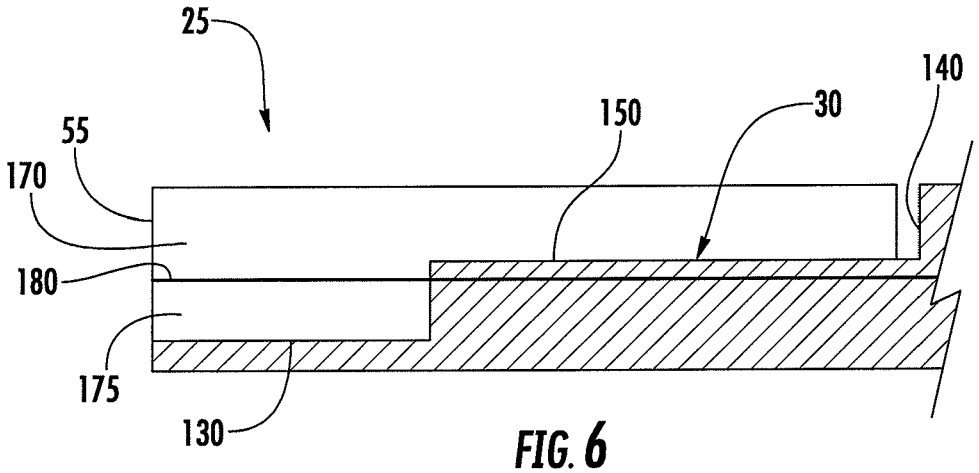
FIG. 6 is a schematic cross-sectional view of the structure along a line of weakness according to an example embodiment.
Figure 7A:
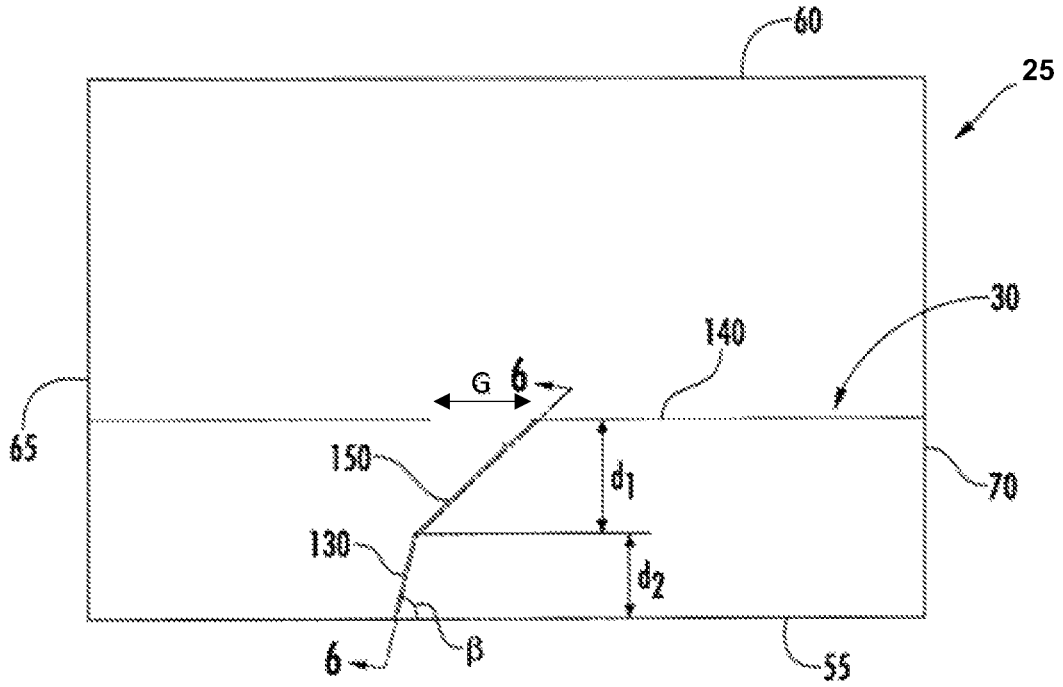
FIG. 7A is a plan view of a sheet for creating the wrapper according to yet another example embodiment.
Figure 7B:
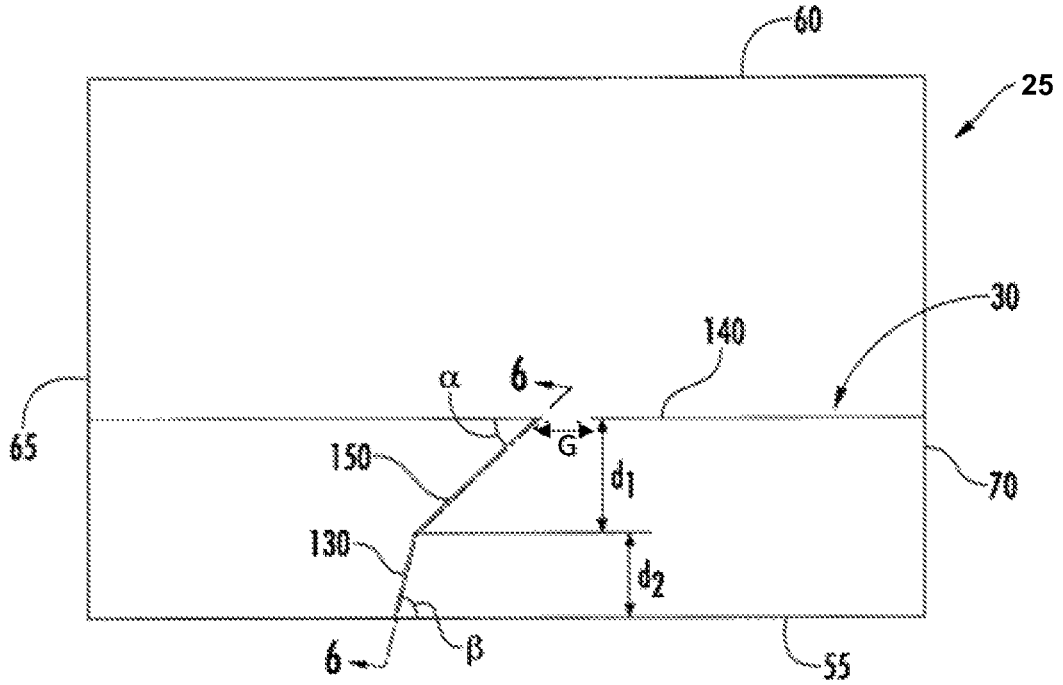
FIG. 7B is a plan view of a sheet for creating the wrapper according to still another example embodiment.
Figure 7C:
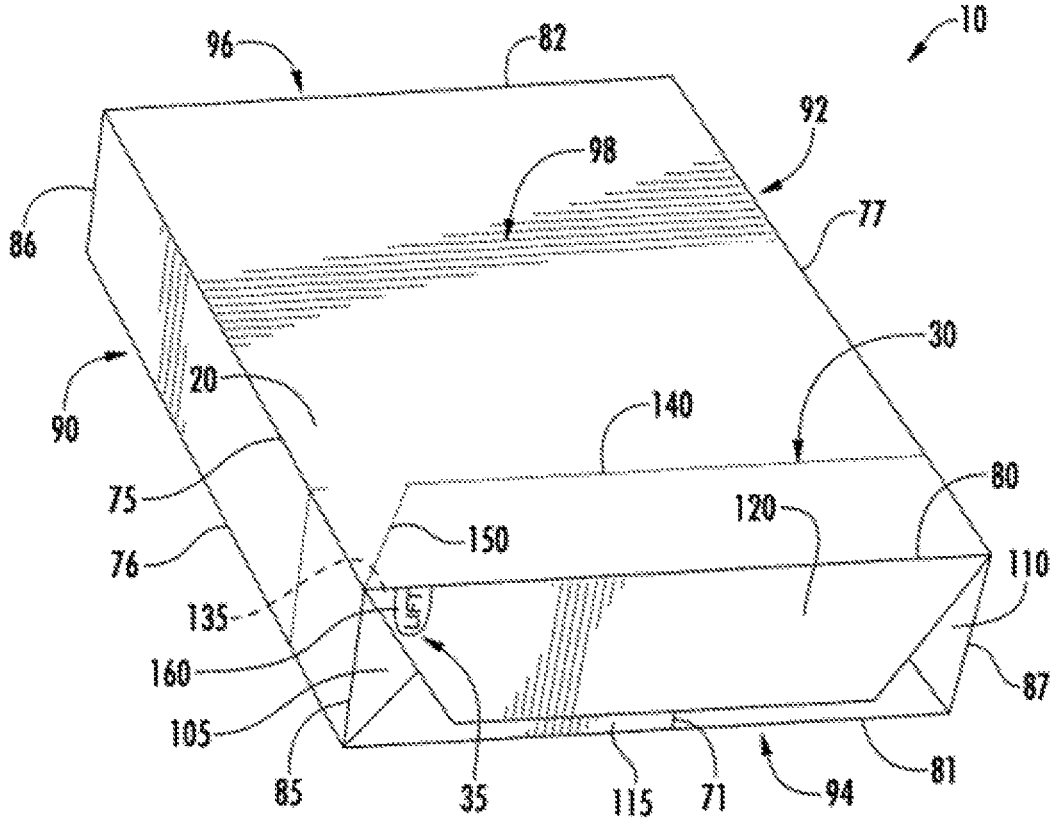
FIG. 7C is a perspective view of a top side of a package having a wrapper formed of a structure in a wrapped configuration according to another example embodiment.

Turning now to FIG. 6, although in some embodiments the structure 25 may be a single layer structure, in other embodiments, the structure 25 may comprise a laminate structure comprising two or more layers of material, such as a first layer 170 and a second layer 175. The first and second layers 170, 175 may be laminated together using a permanent adhesive 180 or, in some cases and/or in some areas of the laminate, the first and second layers may be laminated together using pressure sensitive adhesive, such that the first layer 170 can be pulled away from the second layer 175 for various reasons. In some cases, the first layer 170 may comprise oriented polypropylene (OPP) and the second layer 175 may comprise polyethylene terephthalate (PET). For example, in one embodiment, the structure 25 may be a laminate structure configured as follows: 92 ga PET/adhesive/OPP.

In some embodiments, a depth of the line of weakness 30 may be greater along at least part of the first line of weakness portion 130 and/or the connecting line of weakness portion 150 as compared to the second line of weakness portion 140, such as to facilitate the initiation of a tear in the first line of weakness portion and/or the connecting line of weakness portion. For example, the first line of weakness portion 130 may be cut all the way through the first layer 170 and at least partially through the second layer 175, as shown, whereas the connecting line of weakness portion 150 may be cut only through the first layer 170 (e.g., either partially or all the way through the first layer). Similarly, the second line of weakness portion 140 may be cut to the same depth as the connecting line of weakness portion 150, as shown in the depicted embodiment. In this way, when the user grips the top flap 120 of the envelope fold and starts to pull (as shown in FIGS. 1A-2), the deeper cut in the area gripped by the user (e.g., the first line of weakness portion 130, proximate the edge 35 of the envelope fold) may allow the first line of weakness portion 130 to tear all the way through the structure 25 more easily than other portions of the structure. In embodiments in which the line of weakness 30 is laser scored, the first line of weakness portion 130 may be formed as a deeper cut by using an increased power setting as compared to the power setting used to create the connecting line of weakness portion 150 and/or the second line of weakness portion 140.

Once the tear has been initiated in the desired location, however, continued application of a pulling force by the user may propagate the tear along the first line of weakness portion 130, into the connecting line of weakness portion 150, and into and along the second line of weakness portion 140, regardless of the shallower depth of the line of weakness 30 in the connecting line of weakness portion 150 and/or the second line of weakness portion 140. Rather, the shallower depth of cut over the respective portions of the line of weakness 30 can reduce the risk that the media wrapper 20 will inadvertently be opened or removed from the ream of paper (for example) or other product, such as during transportation, and makes it more likely that the wrapper will only be opened when a tear is initiated in the first line of weakness portion 130 and is propagated into the connecting line of weakness portion 150 and the second line of weakness portion 140 through the continued application of force by the user.

In other embodiments, a method of forming a media wrapper for wrapping a stack of print media is provided, where the method includes providing a structure having a front edge, a rear edge, a left edge, and a right edge, such as described above and depicted in FIG. 5. According to embodiments of the method, the structure may be wrapped around a stack of print media so as to define a left side, a right side, a front side, a rear side, a top side, and a bottom side of a wrapped package formed by two pairs of longitudinal fold lines, two pairs of transverse fold lines, and two pairs of lateral fold lines, as shown in FIGS. 1A and 1B.

One of the left or right edges of the structure may be sealed in an overlapping configuration with respect to the other of the left or right edges of the structure to form a girth seal on the bottom side of the wrapped package, as shown in FIG. 1B, and the front and rear edges of the structure may be folded into an envelope fold so as to form the front and rear sides of the wrapped package by creating fold lines arranged to form a pair of side flaps, a bottom flap overlapping the side flaps, and a top flap overlapping the bottom flap for each of the front and rear sides of the wrapped package. Each top flap may be sealed to the corresponding bottom flap. A line of weakness may be created in the structure (e.g., prior to folding of the structure and wrapping it around the stack of print media to form the media wrapper), where the line of weakness comprises a first line of weakness portion that extends along a fold line of the envelope fold forming a respective one of the front or rear sides of the wrapped package, a second line of weakness portion that extends substantially perpendicularly to the respective longitudinal fold lines, and a connecting line of weakness portion that extends between the first line of weakness portion and the second line of weakness portion and is disposed at a non-zero angle with respect to each. For example, the line of weakness may be created by the paper converter, such that the process of including such a feature is transparent to the paper OEM.

In some embodiments, the line of weakness may be created by varying a depth of the line of weakness such that the depth is greater along at least part of the first line of weakness portion or the connecting line of weakness portion as compared to the second line of weakness portion, as described above with respect to FIG. 6. For example, in some embodiments the line of weakness may be laser scored, and a higher power setting may be used to create the first line of weakness portion 130, whereas a relatively lower power setting may be used to create the connecting line of weakness portion 150 and/or the second line of weakness portion 140. Moreover, the first line of weakness portion may be configured (e.g., sized, shaped, positioned, etc.) so as to at least partially define one of the side flaps of the wrapped package (e.g., coinciding with a fold line forming one of the side flaps). In some cases, a printed indicia may be provided proximate the first line of weakness portion indicating a location for a user to initiate a tear to open the media wrapper, as described above.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A media wrapper for wrapping a stack of print media, the media wrapper comprising:

a structure configured to be wrapped and sealed around a stack of print media to form a wrapped package, the structure having a front edge, a rear edge, a left edge, and a right edge, wherein upon wrapping the structure around the stack of print media, the structure is configured to form two pairs of longitudinal fold lines, two pairs of transverse fold lines, and two pairs of lateral fold lines defining a left side, a right side, a front side, a rear side, a top side, and a bottom side of the wrapped package, wherein one of the left or right edges of the structure is configured to overlap the other to form a girth seal on the bottom side of the wrapped package, wherein the front and rear edges of the structure are each configured to be folded into an envelope fold so as to form the front and rear sides of the wrapped package, each envelope fold being defined by fold lines arranged to form a pair of side flaps, a bottom flap overlapping the side flaps, and a top flap overlapping and sealed to the bottom flap, and:

a first line of weakness that extends along a fold line of the envelope fold forming a respective one of the front or rear sides of the wrapped package, a second line of weakness that extends substantially perpendicularly to the respective longitudinal fold lines, and a third line of weakness that extends between the first line of weakness and a first end of the second line of weakness, is disposed at a non-zero angle with respect to each of the first line of weakness and the second line of weakness, and is separated from a second end of the second line of weakness by a gap.

2. The media wrapper of claim 1, wherein the non-zero angle of the third line of weakness is selected such that a tear initiated along the first line of weakness is directed towards the second line of weakness and propagates along substantially an entire length of the second line of weakness and through the gap.

3. The media wrapper of claim 1, wherein a depth of at least part of the first line of weakness or the third line of weakness is greater than the depth of the second line of weakness.

4. The media wrapper of claim 1, wherein the first line of weakness at least partially defines one of the side flaps of the envelope fold.

5. The media wrapper of claim 1, wherein the structure further includes a printed indicia proximate the first line of weakness indicating a location for a user to initiate a tear to open the media wrapper.

6. The media wrapper of claim 1, wherein the first line of weakness is disposed underneath and is hidden by one of the side flaps, bottom flap, or top flap of the envelope fold.

7. A method of opening the media wrapper of claim 1, comprising gripping the edge of one of the side flaps, bottom flap, or top flap of the envelope fold and pulling of the wrapper until an end portion of the wrapper is removed to create an access opening for removing the at least a portion of the stack of print media.

8. A media wrapper for wrapping a stack of print media, the media wrapper comprising:

a structure configured to be wrapped and sealed around a stack of print media, wherein in an unwrapped configuration the structure has a front edge, a rear edge, a left edge, and a right edge, and wherein in the unwrapped configuration the structure comprises:

a first line of weakness that begins at the front edge of the structure and extends away from the front edge of the structure to a point disposed from the front edge of the structure, a second line of weakness that extends substantially parallel to the front edge of the structure and is spaced from the first line of weakness, and a third line of weakness extending between the first line of weakness and the second line of weakness at a non-zero angle with respect to each of the first and second line of weakness, wherein the second line of weakness is broken by a gap.

9. The media wrapper of claim 8, wherein a tear initiated along the first line of weakness extends into the third line of weakness, and from the third line of weakness to the second line of weakness.

10. The media wrapper of claim 9, wherein the tear propagates through the gap to open a wrapped stack of print media.

11. The media wrapper of claim 8, wherein a depth of at least part of the first line of weakness or the third line of weakness is greater than the depth of the second line of weakness.

12. The media wrapper of claim 8, wherein the second line of weakness portion partially circumscribes the wrapped package.

13. The media wrapper of claim 8, wherein a distance between a proximal end of the first line of weakness and the second line of weakness is greater than a distance between the proximal end of the first line of weakness and the front edge of the structure.

14. The media wrapper of claim 8, wherein an angle formed between the front edge of the structure and the first line of weakness comprises between about 70 degrees and about 90 degrees.

15. The media wrapper of claim 8, wherein an angle formed between the third line of weakness and the second line of weakness comprises between about 35 degrees and about 55 degrees.

* * * * *